United States Patent [19]

Miskiewicz

[11] Patent Number: 4,499,798

[45] Date of Patent: Feb. 19, 1985

[54] REMOVABLE CAP MEMBERS FOR PLIERS

[76] Inventor: Leonard A. Miskiewicz, 219 Sprucewood St., Pittsburgh, Pa. 15210

[21] Appl. No.: 492,649

[22] Filed: May 9, 1983

[51] Int. Cl.[3] ..... B25B 7/02

[52] U.S. Cl. ..... 81/423

[58] Field of Search ..... 81/418, 421–424, 81/180 B, 186; 30/341–342, 260; 403/339; 269/278–280, 283–284, 259, 261, 263, 271–272; 72/413

[56] References Cited

U.S. PATENT DOCUMENTS 1,505,510 8/1924 Uhl ..... 81/423
1,512,622 10/1924 Marsh ..... 30/342 X
1,556,755 10/1925 Burman ..... 81/423

FOREIGN PATENT DOCUMENTS 628232 12/1952 Belgium .
364026 11/1922 Fed. Rep. of Germany ..... 81/41 B
857480 5/1963 Fed. Rep. of Germany .

*Primary Examiner*—Frederick R. Schmidt
*Assistant Examiner*—Debra S. Meislin
*Attorney, Agent, or Firm*—Thomas H. Murray; Clifford A. Poff

[57] ABSTRACT

A pair of pliers is provided with a slot in each jaw to receive the tongue member of a special purpose plier cap member having a unique working face. The cap member may be quickly assembled, removed and replaced. The cap members have a tongue which engages a pair of rods secured across the jaw slots and also have a finger-like projection which engages an arcuate recess at the base of the slot. The cap members are retained by engagement of the finger-like projection in the arcuate recess and by engagement of grooves in the cap member tongue with the bars which are secured across the jaw slot.

2 Claims, 4 Drawing Figures

REMOVABLE CAP MEMBERS FOR PLIERS

BACKGROUND OF THE INVENTION

This invention relates to removable cap members which can be quickly applied to the jaws of a pair of pliers to provide multiple tool capability from a single tool with interchangeable cap members. In particular, the present invention concerns a means for quickly securing and replacing the removable cap members.

STATEMENT OF THE PRIOR ART

There are hundreds of different jaw profiles which have been employed in the manufacture of pliers—each carrying out a special and unique function which is usually related to clamping a workpiece but may also be related to cutting, punching, embossing or otherwise working on a workpiece.

At the present time, a tool purchaser could invest substantial funds in obtaining multiple pairs of pliers for carrying out multiple functions.

The use of interchangeable cap members in a plier-like tool is described in Belgium Pat. No. 628,232 and German Pat. No. 857,480.

STATEMENT OF THE INVENTION

According to the present invention I have provided a pair of cap members and preferably multiple pairs of cap members which can be quickly and firmly secured to the jaws of a single set of pliers to extend the utility of that single set of pliers. The jaws of the pliers are provided with parallel slots for receiving a tongue element of each cap member. A pair of retainer bars is applied across the slot, one on each side thereof. The plier jaw is provided with a groove corresponding to a finger-like projection of the cap member. Application of the cap member is accomplished by inserting the cap member between the opposed bars and twisting the cap member about the proximate one of the two bars and concurrently introducing the finger-like projection into the jaw groove. In the assembled position, the cap member engages both of the rods and the finger-like projection is secured in the jaw groove.

DESCRIPTION OF THE PREFERRED EMBODIMENTS

Figure 1:
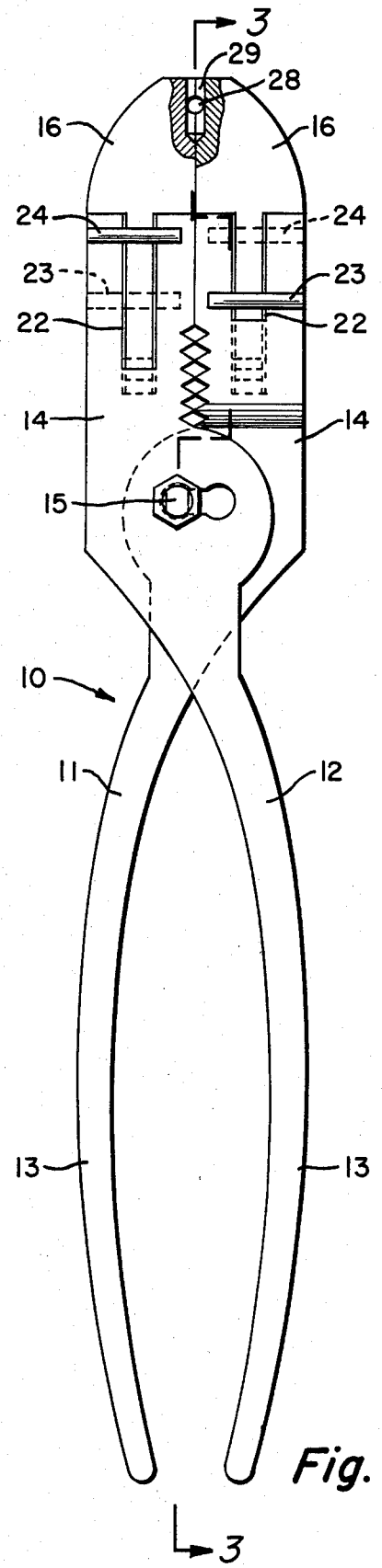
FIG. 1 is a side elevation of a typical pair of pliers showing in cross-section the jaws and a typical pair of cap members according to this invention.

As shown in FIG. 1, a pair of pliers 10 includes a pair of elements 11, 12. Each element includes a handle 13 at one end and a jaw 14 at the other end. The elements 11, 12 are pivotally connected at their mid-regions by a pivot pin 15 defining a pivot axis 15*a*. As the handles 13 are drawn together, the jaws 14 are drawn together. The jaws 14 oppose each other and are arranged to clamp an interposed workpiece.

According to the present invention, cap members 16 are provided, each having a working face 17 at its forward end, a tongue 18 and a finger-like projection 19. The tongue 18 is generally parallel to the working face 17 and is provided with two parallel spaced-apart grooves 20, 21 on opposed sides and at different locations along the length of the tongue 18.

Figure 3:
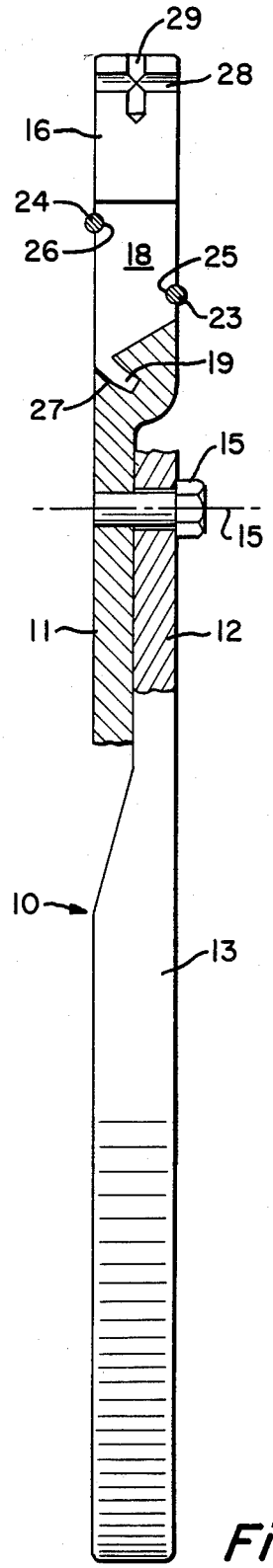
FIG. 3 is a sectional view of the pair of pliers of FIG. 1 taken along the line 3—3.
Figure 4:
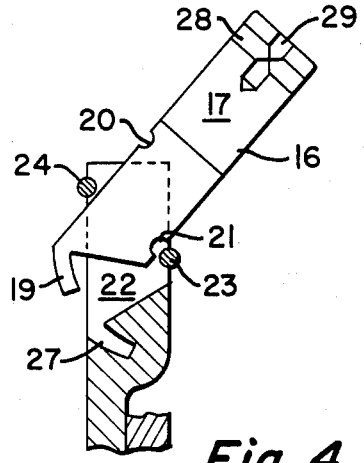
FIG. 4 is a fragmentary illustration of the jaw portion of the pliers of FIG. 3 and a cap member illustrating the assembly of the cap member to the plier's jaw.

Each jaw 14 is provided with a slot 22 extending in a direction parallel to said pivot axis 15*a*. The two slots 22, open from the forward end of the jaws 14 and define parallel channels for receiving the tongue members 18 of cap members 16. A pair of parallel rods 23, 24, secured in grooves 25, 26 respectively on opposed sides of the jaws, extend across the slot 22. The rods 23, 24 are spaced at different distances from the pivot axis 15*a*. The function of the parallel rods 23, 24 is to engage the grooves 21, 20 respectively of a cap member 16. This is illustrated in FIGS. 3, 4. At the base of each slot 22, a recess 27 is provided for receiving the finger-like projection 19 from a cap member 16. The recess 27 follows an arc drawn from the proximate one of the rods 23.

Figure 2:
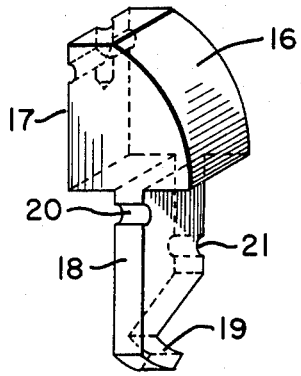
FIG. 2 is a perspective illustration of a cap member according to this invention.

A cap member 16 is inserted by placing the tongue 18 within slot 22 between the rods 23, 24; engaging the groove 21 with the rod 23 and the finger-like projection 19 with the arcuate recess 27. The tongue 18 has a thickness and width corresponding to the slot 22. The cap member 16 is pivoted about the rod 23 until the finger-like projection 19 is fully seated in the arcuate recess 27 and the groove 20 engages the rod 24. This secured relation is illustrated in FIGS. 1 and 3. It will be observed from inspection of FIGS. 1 and 2 that one of the rods 24 is distal to the pliers and the other rod 23 is proximate to the pliers.

As shown in FIGS. 1 and 3, the two cap members 16 are pivoted in opposite directions for assembly to the pliers 10. It is possible to reverse the location of the rods 23, 24 and the grooves 25, 26 and the arcuate recess 27 so that both cap members can be inserted from the same side of the pliers 10. The reversal will also require a reversal of the grooves 20, 21 and the finger-like projection 19 of the respective cap member 16.

The working face 17 is illustrated as having a pair of intersecting grooves 28, 29. The opposed working faces 17 may be provided with a myriad of alternative working face configurations to accommodate specific work functions. The precise configuration of the working faces 17 can be considered outside the scope of the present invention. Any desirable working face combination can be adapted to the working faces 17.

SUMMARY

The present invention provides an inexpensive means for converting a single pair of pliers into a variety of special purpose tools by permitting rapid interchange of selected cap members. The cap members are quickly and easily assembled and may be quickly removed and replaced. No moveable parts such as detent retainers or fastening screws are required to accomplish the objective of the present invention. It is, of course, feasible to install supplemental detent devices or set screws or other locking features to retain the cap member 16 on the jaws 14. In the preferred embodiment of the invention, no supplemental locking features are employed.

What is claimed is:

1. In combination with pliers having a pair of plier elements pivotally connected at a pivot axis adjacent their mid-regions and each having a jaw at one end and a handle at the other end, said jaws being opposed and arranged to provide for clamping of an interposed workpiece, said handles being opposed and arranged to be closed together to close said jaws together, each said jaw having opposed sides and a cap-receiving portion which includes a slot extending in the direction which is parallel to the pivot axis of the pliers and which extends from an open end adjacent a forward end of said jaws to a base spaced from said open end; a pair of rods secured to each jaw one on each side thereof, said rods extending across said respective slot, the rods on each jaw being parallel and being spaced at different distances from the said pivot axis;

an arcuate recess extending in each jaw from said base of said slot along a circular arc centered on one of said rods;

a pair of cap members, each having a working face at its forward end and a tongue which extends away from said working face and generally parallel thereto, each said tongue having a thickness corresponding to the width of a respective said slot and having an arcuate finger-like projection adapted to enter the respective said arcuate recess; each said tongue having opposed sides and a pair of spaced-apart parallel grooves are on each side thereof, each grooves being adapted to engage a respective one of the said rods when the said finger-like projection is engaged in said arcuate recess whereby a pair of said cap members are cooperable with said cap-receiving portions to be selectively assembled on said pliers jaws with said working faces opposed to cooperate in carrying out a work function.

2. The combination of claim 1 wherein the said rods on one said plier element are non-aligned with the respective said rods on the other said plier element.

* * * * *